United States Patent [19]

Grizzle et al.

[11] Patent Number: 4,634,052

[45] Date of Patent: Jan. 6, 1987

[54] ADJUSTABLE ARC SPRINKLER HEAD

[75] Inventors: Glen Grizzle, Corona; Stephen L. Tyler, Diamond Bar, both of Calif.; Joseph J. Walto, Chaska, Minn.

[73] Assignee: The Toro Company, Minneapolis, Minn.

[21] Appl. No.: 668,347

[22] Filed: Nov. 5, 1984

[51] Int. Cl.[4] ..... B05B 15/10

[52] U.S. Cl. ..... 239/205; 239/DIG. 1

[58] Field of Search ..... 239/203–206, 239/240, 242, DIG. 1; 74/10.2, 526; 70/190

[56] References Cited

U.S. PATENT DOCUMENTS

| | | | |
|---|---|---|---|
| 1,526,207 | 2/1925 | Dumas | 70/190 |
| 1,564,220 | 12/1925 | Dumas | 70/190 |
| 1,995,909 | 3/1935 | Williams et al. | 70/190 |
| 2,391,956 | 1/1946 | Eastman | 74/526 |
| 2,477,589 | 8/1949 | Shane | 74/526 |
| 2,974,540 | 3/1961 | Bertling | 74/526 X |
| 3,107,056 | 10/1963 | Hunter | 239/240 X |
| 3,214,985 | 11/1965 | Danek et al. | 74/526 X |
| 3,564,929 | 2/1969 | Halstead | 74/526 X |
| 3,662,610 | 5/1972 | Thoen | 74/526 X |
| 3,674,210 | 7/1972 | Faragasso | 239/204 |
| 4,210,181 | 7/1980 | Clevenger | 74/526 X |

*Primary Examiner*—Joseph F. Peters, Jr.
*Assistant Examiner*—Kevin Patrick Weldon
*Attorney, Agent, or Firm*—James W. Miller

[57] ABSTRACT

An improved adjustable arc sprinkler head (2) includes a pop-up riser (20). Riser (20) comprises a housing (26) having a rotatable nozzle assembly (28) carried adjacent the top thereof. A driven gear (50) is fixed to nozzle assembly (28) and cooperates with a drive train contained inside a motor compartment (30) in riser housing (26). An adjustment member (58) is normally rotatably locked to driven gear (50) by matching serrations (69) and (70). Nozzle assembly (28) is moveable downwardly relative to riser housing (26) sufficiently far to disengage serrations (69) and (70) and allow driven gear (50) to be rotated relative to adjustment member (58). This rotation varies the circumferential distance between two stops (56) and (64) carried on driven gear (50) and adjustment member (58) to vary the angular extent of the arc segment being watered by sprinkler head (2).

9 Claims, 4 Drawing Figures

ADJUSTABLE ARC SPRINKLER HEAD

TECHNICAL FIELD

This invention relates to a rotary sprinkler head that rotates in a circle, or a portion thereof, for watering a ground area adjacent the sprinkler head. More particularly, the present invention relates to a sprinkler head having an improved means for adjusting the angular extent of the arc segment which the sprinkler head waters.

BACKGROUND OF THE PRIOR ART

Rotary sprinkler heads are known which comprise a nozzle that rotates in a circle, or a portion thereof, for watering the arc segment subtended by the angular rotation of the nozzle. Typically, the sprinkler head is able to rotate unidirectionally when it rotates in a full 360° circle. However, when it waters less than a full circle, such as an arc segment of 120°, the sprinkler nozzle must reverse rotational direction at each end limit of the arc segment to sweep back and forth over the arc segment.

U.S. Pat. No. 3,107,056, issued Oct. 15, 1963, discloses a rotary sprinkler head of this general type. In this patent, the rotatable nozzle is keyed to a gear that is driven by a gear train which can be shifted to bring one of two final drive gears into engagement with the driven gear. Each of the final drive gears is rotating in a different direction so that the driven gear will be rotated in different directions depending upon which of the final drive gears is swung into engagement with the teeth on the driven gear. The shifting movement of this drive assembly is accomplished by means of a trip arm which engages against one of two stops. The first stop is mounted on the driven gear itself. The second stop is mounted on an adjusting ring that overlies the driven gear and which is normally carried with the driven gear for rotation therewith. The distance between the first and second stops determines the angular extent of the arc segment being watered.

The sprinkler head referred to in this prior patent disclosed a means for rotating the adjusting ring relative to the driven gear to adjust the distance between the stops and hence the distance of the arc segment being watered. This mechanism comprises a spring loaded button or plunger which could be biased inwardly against the bias of the spring to engage one of a number of perforations in the adjusting ring. When this was done, the operator was then able to grab and manually rotate the nozzle, and hence the driven gear, relative to the adjusting ring which was prevented from rotating through its engagement with the plunger. The relative rotation between the adjusting ring and the driven gear would vary the circumferential distance between the stops carried on each. This type of structure has been used in many of the rotary sprinkler heads manufactured and sold by The Toro Company of Minneapolis, Minn., the assignee of the present invention. Such sprinkler heads include the Super 600® sprinkler head.

While the above-noted method is effective in causing the distance between the stops to be adjusted, it has a number of disadvantages. For one thing, it requires two hands by the operator, one to hold the button inwardly and the other to manually turn the nozzle structure. This can be difficult to do. Moreover, it is relatively easy for an outsider to get access to the button so that vandals could easily readjust the arc segments after an installer had first set them. This would, of course, require the installer to come back and readjust the arc segments which is a laborious and time-consuming process.

A newer sprinkler of this general type has been made and sold by Hunter Industries and is known as the Series 75 sprinkler. In this sprinkler, the nozzle structure and drive assembly are part of a riser that pops up out of the sprinkler head body under the influence of fluid pressure. Except for the nozzle opening, that portion of the riser which extends above the body level in the popped up position of the riser is substantially enclosed so that the interior of the riser is difficult to gain access to. The driven gear and adjusting ring structure are contained in the interior of the riser.

However, the problem remains of adjusting the distance between the stops on the driven gear and the adjusting ring for adjusting the extent of the arc segment. This is accomplished in the Hunter sprinkler by having a keyhole-shaped opening in the top cover of the riser which leads downwardly into the interior of the riser. This opening allows a keyhole-shaped tool, i.e. a screwdriver-like tool with a head having two outwardly extending ears in the shape of a key, to extend downwardly into the riser housing. The end of this tool is engageable with a gear that is engaged with a gear structure on the outside of the adjusting ring. Rotation of the tool will rotate this gear, and hence the adjusting ring, to cause the adjusting ring to move relative to the driven gear and change the distance between the stops.

The solution embodied in the Hunter sprinkler head does not solve the problem of vandal-resistance. While enclosing the driven gear and adjusting ring inside the riser and requiring the use of an elongated tool to adjust the two is somewhat more effective than some prior art structures, the Applicant has found that any elongated tool, such as a plain screwdriver, is often effective for reaching down and actuating the drive gear that causes rotation of the adjusting ring. Accordingly, it would be possible for vandals to maliciously readjust the Hunter sprinkler head simply by using an ordinary screwdriver. This then requires the sprinkler installer to come back out and readjust the arc segments which is obviously disadvantageous. Moreover, the use of a special tool to adjust the stops is a disadvantage. Such tools tend to get lost. If the installer does not have it with him, he is not able to accomplish the necessary stop adjustment.

SUMMARY OF THE INVENTION

One aspect of this invention is a sprinkler head of this general type having an improved means for adjusting the length of the arc segment to be watered. The adjusting means of this invention obviates the disadvantages noted above and is considerably more vandal-resistant than those of the prior art. Moreover, it does not require the use of any special tool for adjustment.

The sprinkler head of the present invention comprises a housing having a rotatable nozzle assembly. The nozzle assembly includes a driven gear and an adjustment member. The driven gear and adjustment member have matching serrations which are normally engageable to prevent relative rotation between the two. In addition, a means is provided for rotating the driven gear in opposed directions to rotate the nozzle assembly in an arc segment between first and second limits. The arc segment has its length determined by two stop members, one of which is carried on the driven gear and the other on the adjustment member. The present invention relates to an improved means for adjusting the driven gear relative to the adjustment member to change the distance between the stops. This includes means for allowing the driven gear and adjustment member to be axially separated by downwardly pushing the nozzle assembly relative to the housing until the serrations on the two disengage. Rotary adjustment of the circumferential distance between the arc stops is now allowed simply by rotating the nozzle assembly to rotate the driven gear relative to the adjustment member.

Another aspect of the present invention is a means for locking out this adjusting mechanism when desired in an attempt to defeat vandalism. This is accomplished by using a lock pin on the nozzle assembly that is capable of interfering with the housing to prevent the downward movement of the nozzle assembly which is necessary to disengage the driven gear from the adjustment member. This lock pin can be manipulated only through the closed upper end of the nozzle assembly by means of a specially shaped tool, i.e. an allen wrench, which a vandal is not likely to have with him.

BRIEF DESCRIPTION OF THE DRAWINGS

The present invention will be described in more detail hereafter in the Detailed Description, when taken in conjunction with the following drawings, in which like reference numerals refer to like elements throughout.

DETAILED DESCRIPTION

Figure 1:
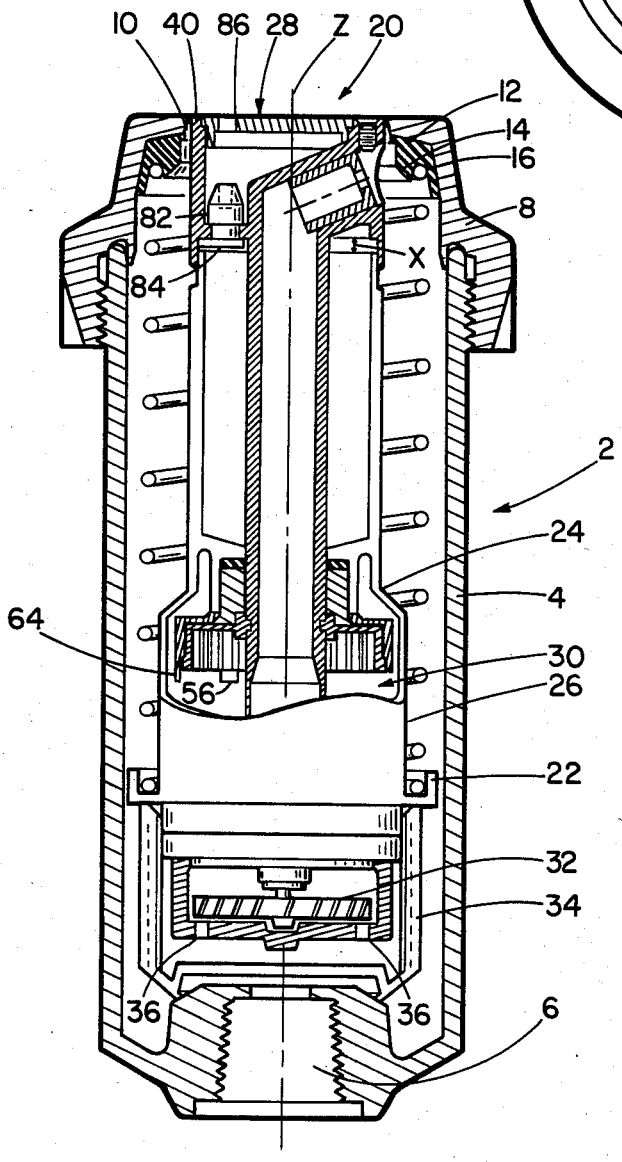
FIG. 1 is a side elevational view of a sprinkler head according to the present invention, with various portions of the sprinkler head being broken away and shown in cross-section to illustrate the interior of the riser housing and particularly the driven gear and adjustment member.
Figure 2:
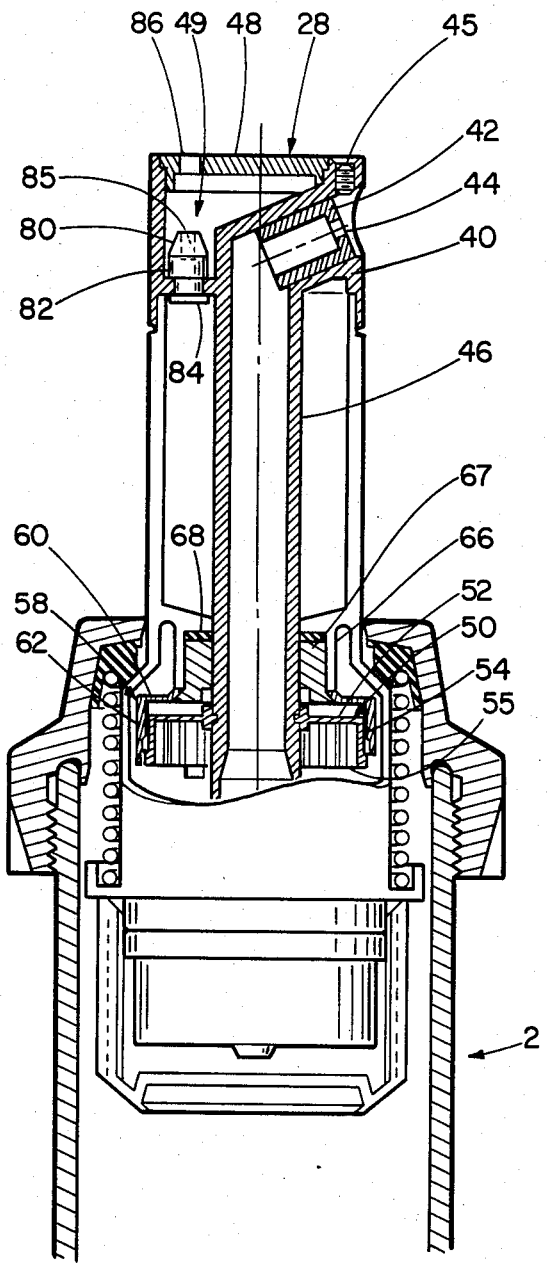
FIG. 2 is a view similar to FIG. 1, but showing the riser elevated with the nozzle assembly pushed down to its depressed position to separate the driven gear and adjustment member and allow an arc adjustment to occur.

Referring now to FIG. 1, an improved sprinkler head according to this invention is generally illustrated as 2. Sprinkler head 2 as shown herein comprises a pop-up sprinkler similer to the Super 600® sprinkler manufactured by The Toro Company of Minneapolis, Minn., the assignee of the present invention. Such a pop-up sprinkler includes a riser 20 that pops up from a lower retracted position in which it is contained inside the housing, as shown in FIG. 1, to an upper raised position in which it is raised out of the housing for conducting a sprinkling operation, as shown in FIG. 2. However, the present invention which relates to an adjustable drive structure contained inside riser 20 is also useable with sprinklers that do not have a pop-up riser.

Sprinkler head 2 includes a cylindrical body 4 having a water inlet 6 at the lower end thereof. Inlet 6 has interior screw threads for coupling it to a conventional fitting on a water supply pipe or line. The upper end of housing 4 is closed by a screw threaded cap 8. Cap 8 has a central circular opening 10 through which riser 20 extends. A seal 12 is press fit or otherwise secured into the top of cap 8 beneath the top surface thereof. Seal 12 includes an annular groove that receives the top end of a spring 16 whose lower end is received on an annular flange 22 on riser 20. Spring 16 forces riser 20 down to its lower retracted position as shown in FIG. 1. In addition, seal member 12, which may be of a resilient material such as rubber, has a slanted sealing surface 14 that engages with a similarly shaped surface 24 on the outside of riser 20 for sealing the riser 20 to the outer body 4 in its upper or raised position, as shown in FIG. 2. This prevents water from leaking out between riser 20 and cap 8 when the sprinkler has the riser in its up and operating position.

Riser 20 comprises a stationary non-rotatable and substantially cylindrical housing 26 which supports at the very top thereof a rotatable nozzle assembly 28. Housing 26 has a lower motor compartment 30 which contains a drive means (not shown) for rotating nozzle assembly 28 about the longitudinal axis through housing 26, which axis is designated as Z in FIG. 1. This drive means bascially comprises a reduction gear set supported inside motor compartment 30 which is driven by a turbine wheel 32 located outside compartment 30. A cylindrical open mesh screen 34 filters the water which enters the outer body 4 from inlet 6 before it passes into contact with turbine wheel 32 through suitable passageways or openings 36. After the water flow hits turbine wheel 32 to activate the reduction gear set, it then flows upwardly into and through riser housing 24 to enter nozzle assembly 26 and be sprinkled outwardly from the sprinkler head 2. During this passage, the water does not flow through the motor compartment 30 directly since that compartment contains a lubricating fluid such as oil or grease to lubricate the reduction gear set. Instead, it is conducted through any suitable passageways or channels into a portion of the nozzle assembly 28 to be described hereafter. One such method br series of channels is disclosed in U.S. Pat. No. 3,107,056, which patent is incorporated herein by reference.

The drive means disclosed inside motor compartment 30 may be of any suitable design for allowing reversable rotation of the nozzle assembly. It may be of a design such as that in the above incorporated U.S. Pat. No. 3,107,056, i.e. a shiftable drive assembly having two final drive gears which rotate in reversely rotating directions. Nozzle assembly 28 is driven in one direction or another depending upon which of the two final drive gears is engaged therewith. The shifting motion of the drive assembly to disengage one final drive gear and engage the other is caused by a trip arm or the like which hits against one of two separate stops contained on the nozzle assembly, the circumferential distance between the stops determining the angular extent of the arc segment being watered by the nozzle. Such a drive assembly and trip arm are well known in the art and may have any suitable design.

Nozzle assembly 28 includes a substantially cylindrical nozzle block 40 having a nozzle 42 set thereinto. Nozzle 42 has an outlet orifice 44 which can be sized to deliver different flow rates of sprinkling fluid. An adjustable set screw 45 can be made to project into the water flow from outlet 44 to break the stream up and cause it to be dispersed over the arc segment being watered. In addition, an elongated cylindrical tube 46 extends downwardly from nozzle block 40, is hollow and terminates in a lower end (not shown) which receives the water flow from inlet 6 after that flow has left turbine 32. Nozzle block 40 includes an open upper end that is plugged by a plug member 48 that is permanently secured in place. The interior of nozzle block 40 defines a hollow, enclosed chamber 49 in which an adjustment lock pin 80 is received. The structure and operation of lock pin 80 will be described in more detail hereafter.

Referring to FIGS. 1 and 2, nozzle tube 46 that forms part of nozzle assembly 28 extends downwardly into motor compartment 30 on its way to the passageways which feed water to the nozzle tube 46 after passing from turbine 32. A driven gear 50 is keyed or otherwise non-rotatably secured to nozzle tube 46 inside motor compartment 30. Gear 50 is a shell-like member having a horizontal upper surface 52 and a downwardly depending skirt 54. A set of gear teeth 55 is located on the inner diameter of skirt 54 for alternately meshing with the final drive gears of the aforementioned drive means. In addition, a downwardly depending stop 56 in the form of a tab extends from the lower edge of skirt 54 for cooperation with the trip arm of the drive means.

Located immediately above the driven gear 50 in motor compartment 30 is an adjustment member 58 which is shaped similarly to gear 50. In other words, adjustment member 58 includes a horizontal surface 60 and a downwardly depending skirt 62 which is, however, shaped somewhat larger than skirt 54 so as to overlie and be concentric with skirt 54. Adjustment member 58 also includes a downwardly depending stop 64 in the form of a tab which extends from the lower edge of skirt 62. In addition, the horizontal surface 60 of adjustment member 58 is trapped between an annular flange 66 at the top of motor compartment 30 and a thrust bearing 67 that is press fit into the annular space between flange 66 and nozzle tube 46. Thrust bearing 67 has an outturned lip or the like beneath horizontal surface 60 so as to axially retain the adjustment member in the motor compartment 30. In addition, a small rubber seal 68 is located on top of thrust beafing 67 for sealing against nozzle tube 46 and preventing the grease or lubricating fluid inside the motor compartment 30 from leaking out therearound.

Figure 4:
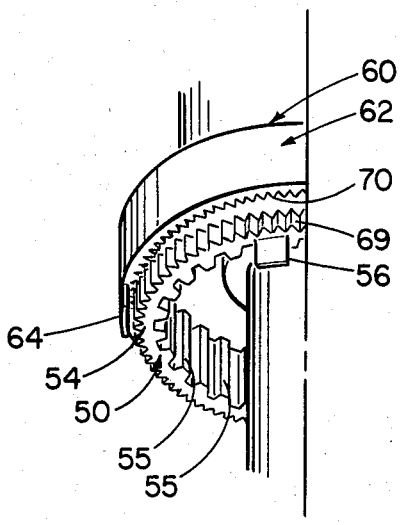
FIG. 4 is a partial perspective view of a portion of the sprinkler head shown in FIG. 1, particularly illustrating the driven gear and adjustment member and the matching serrations between the two for preventing relative rotation.

Adjustment member 58 and driven gear 50 are normally prevented from rotating relative to one another. This rotation preventing means comprises a plurality of matching serrations 69 and 70 which are respectively placed on the outside diameter of skirt 54 of driven gear 50 and the inside diameter of skirt 62 of adjustment member 58. See FIG. 4. These serrations or teeth form a releasable clutch means which couple driven gear 50 and adjustment member 58 to one another for rotation, but which can be released by axially separating driven gear 50 from adjustment member 58. This axial separation is allowed since nozzle assembly 28 is moveable downwardly a short distance relative to riser housing 26. Referring to FIG. 1, normally nozzle assembly 28 will be raised relative to housing 26 so that both the driven gear and adjustment member are engaged and the respective tabs 56 and 64 lie in the same vertical plane. As noted earlier, adjustment member 58 is retained in position by thrust bearing 67 and gear 50 and nozzle assembly 28 will also be retained in engagement with the adjustment member 58 in the FIG. 1 position by the viscosity of the lubricating fluid contained in motor compartment 30 along with the drag afforded on nozzle assembly 28 by seal 68. However, in this orientation, a small gap labeled as X is located between the top of riser housing 26 and the bottom surface of nozzle block 40. This allows nozzle assembly 26 to be pushed down the distance of gap X to axially separate driven gear 50 from adjustment member 58. Obviously, the matching serrations 69 and 70 should have a vertical length somewhat less than the gap X so that they will become completely disengaged when nozzle assembly 28 is pushed downwardly.

The arc segment being watered by the sprinkler head 2 will have its length or angular extent determined by the circumferential distance or spacing between the two stop members 56 and 64. This distance may be easily adjusted when the sprinkler head 2 is running and riser 20 is in its popped up position. In such a position, all the operator has to do to readjust the stops relative to one another is to grab the rotating nozzle assembly 28, e.g. nozzle block 40 and push downwardly until nozzle block 40 is firmly engaged against the upper end of riser housing 26. See FIG. 2. In this position, driven gear 50 has been axially moved downwardly far enough that serrations 69 and 70 are no longer engaged with one another, thereby uncoupling adjustment member 58 from gear 50. After this downward pushing movement, all that is required is that the operator simply manually rotate nozzle block 40, and hence nozzle tube 46 relative to riser housing 26 to cause stop 56 on driven gear 50 to be circumferentially moved relative to stop 64 on the adjustment member 58. Thus, the arc segment is readjusted by a simple downward movement on nozzle assembly 28 followed by a rotation of the assembly.

The present invention is particularly advantageous. Unlike some of the sprinklers of the prior art, in which a button first had to be pushed inwardly and the other hand used to cause rotation, the adjusting operation for this invention requires only one hand. Moreover, access to the interior of the sprinkler head is not required for adjusting. It can be adjusted when the riser is popped up and the sprinkler is operating. In fact, this is the preferred method of adjustment since then the degree of the angular arc adjustment can be immediately determined by visual inspection. The water pressure will also then return nozzle assembly 28 to its raised position with gear 50 engaged with adjustment member 58 after the operator releases it after an arc adjustment operation. Moreover, no special tools or the like are required to cause an adjustment operation to occur. This is done simply by depressing the nozzle assembly and rotating it relative to the rest of the riser.

An auxiliary, but desirable, feature that can be used in such a sprinkler head is the adjustment lock pin shown as 80. Pin 80 is desirably included to make the sprinkler head more vandal-resistant. For example, without the pin 80 someone having knowledge of the sprinkler head structure could come up and adjust the arc simply by depressing nozzle assembly 28 while the system is operating. Thus, there is the possibility for someone to maliciously tamper with all the arc adjustment settings of a sprinkler head system requiring the owner or operator of the system to readjust to the proper settings. Obviously, this is a nuisance and it is desirable to have some means to prevent this.

Figure 3:
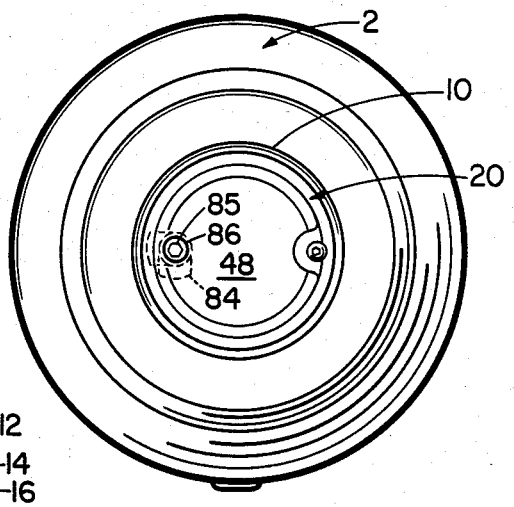
FIG. 3 is a top plan view of the sprinkler head of FIG. 1, particularly illustrating the adjustment lock pin in both the locked and unlocked positions.

In the present invention, a rotatable adjustment lock pin 80 is included in the enclosed chamber 49 in the nozzle body 40. This adjustment lock pin is simply a circular pin 82 that is rotatably mounted in the horizontal bottom wall of nozzle block 40. Pin 80 has an outwardly extending lug 84 which is shaped to fit into the gap X between the nozzle block 40 and the top end of riser housing 26. Pin 80 also has an upper end in which is provided a specially shaped recess 85 that is shaped to receive an allen wrench or other specially shaped tool. In addition, a small circular opening 86 is provided in the plug which forms the top surface of nozzle block 40. Opening 86 is generally in alignment with the lock pin to give access to the lock pin through the plug 48. See FIG. 3 which shows opening 86 and beneath it the recess 85 for reception of the specially shaped tool. In addition, FIG. 3 illustrates both the locked and unlocked positions of lug 84.

Lock pin 80 is simply a rotatable member that is shown in its locked position in FIG. 1. In this position, lug 84 is located in the gap X between the nozzle block and the upper end of the riser housing and effectively prevents any downward movement of nozzle block 40. In this position, no one can grab the nozzle block and force it downwardly because the top of the riser housing is engaged by locking lug 84. To allow an adjustment operation, an allen wrench has to be inserted downwardly through the opening 86 in plug 48 until it engages the recess 85 in the top of the pin. Rotation of the allen wrench will then cause the locking lug 84 to be rotated 90° to a position where it no longer interferes with the downward movement of nozzle block 40. In such a position, the adjustment operation between the driven gear 50 and adjustment member 58 would be allowed since downward movement of nozzle assembly 28 is now possible.

The adjustment lock pin according to the present invention is advantageous. For example, it is contained in an entirely enclosed space and is not otherwise accessible to a vandal. Moreover, it requires a special tool to operate it, an allen wrench, which most vandals are not likely to carry with them. Accordingly, even someone having knowledge of the operation of the sprinkler head would find it difficult to unlock the adjustment lock pin to tamper with the arc adjustment settings.

The advantages and characteristics of the adjustable arc sprinkler head according to this invention have been set forth above. Various other modifications to this invention would, of course, be possible. For example, different types of actuable lock pins could be used to lock out the downward movement of the nozzle block. Moreover, many of the sprinkler components can be made from plastic or any other suitable material. Accordingly, the scope of protection of the present invention is to be limited only by the appended claims.

We claim:

1. An improved adjustable arc sprinkler head of the type having a nozzle assembly which rotates about an axis of rotation; first and second circumferentially spaced stops carried on the nozzle assembly; drive means for rotating the nozzle assembly in opposed first and second directions, wherein the drive means includes means responsive to the stops for reversing the direction of nozzle assembly rotation such that the nozzle assembly waters an arc segment which is subtended by the circumferential distance between the stops; wherein the improvement comprises:

(a) means for normally fixing each of the stops to the nozzle assembly for rotation therewith; and (b) means responsive to a longitudinal movement of the nozzle assembly along the axis of rotation for uncoupling one of the stops from the nozzle assembly such that continued rotation of the nozzle assembly will vary the circumferential distance between the stops.

2. An improved adjustable arc sprinkler head as recited in claim 1, further including selectively operable means for preventing the longitudinal movement of the nozzle assembly to preclude adjustment of the stops.

3. An improved adjustable arc spinkler head of the type having a housing; a rotatable nozzle assembly carried by the housing which rotates about a substantially vertical axis to water an arc segment between first and second limits; drive means for rotating the nozzle assembly in first and second directions and for reversing the direction of rotation at each of the arc segment limits, wherein the drive means includes a driven member secured to the nozzle assembly; an adjustment member having means for coupling the adjustment member to the driven member for rotation therewith, wherein the relative rotational adjustment between the driven member and the adjustment member determines the distance between the first and second limits of the arc segment, and wherein the improvement comprises:

means responsive to movement of the nozzle assembly along the vertical axis for unlocking the adjustment member from the driven member to allow relative rotation between the two, whereby the extent of the arc segment being watered may be adjusted.

4. An improved adjustable arc sprinkler head as recited in claim 3, further including locking means for selectively preventing movement of the nozzle assembly along the vertical axis to preclude the possibility of adjustment between the driven member and the adjustment member.

5. An improved adjustable arc sprinkler head as recited in claim 4, wherein the locking means comprises a rotatable lock pin carried by the nozzle assembly and having means for coacting with a portion of the housing to prevent movement of the nozzle assembly along the vertical axis.

6. An improved adjustable arc sprinkler head, which comprises:

(a) an elongated, non-rotatable housing having a top portion;

(b) a nozzle assembly rotatably carried adjacent the top portion of the housing having at least one nozzle outlet for spraying water that is admitted into the housing, wherein the nozzle assembly is moveable along the axis of the housing from a first raised position to a second depressed position relative to the housing;

(c) an adjustable member contained within the housing having a first stop thereon;

(d) drive means contained within thh housing for rotating the nozzle assembly about the axis of the housing to water an arc segment that is defined by the amount of angular rotation of the nozzle assembly, wherein the drive means includes a driven member secured tothe nozzle assembly for rotating the same and having a second stop thereon, wherein the drive means further includes a trip arm engageable with the first and second stops for reversing the rotational direction of the nozzle assembly such that the arc segment is defined by the circumferential distance between the first and second stops; and (e) wherein the driven member and the adjustment member have means for rotationally locking the driven member and the adjustment member together when the nozzle assembly is in its raised position but which locking means is released when the nozzle assembly is in its depressed position, whereby the distance between the first and second stops can be adjusted by pushing the nozzle assembly downwardly from its raised position to its depressed position and thereafter rotating the nozzle assembly to rotate the driven member relative to the adjustment member.

7. An improved adjustable arc sprinkler head as recited in claim 6, further including an outer body, and wherein the housing and nozzle assembly form a pop-up riser that is reciprocally mounted in the outer body for movement between a lower retracted position and an upper popped up sprinkling position when water is admitted to the outer body.

8. An improved adjustable arc sprinkler head as recited in claim 6, wherein the nozzle assembly comprises a substantially cylindrical nozzle block which is substantially enclosed except for the nozzle outlet and which includes a hollow chamber located therein, wherein a rotatable pin is mounted in said chamber, and wherein the pin includes a locking lug located outside the chamber in a position suited to be interposed between the nozzle block and the top portion of the housing to preclude downward movement of the nozzle assembly and thereby prevent adjustment of the circumferential distance between the stops.

9. An improved adjustable arc sprinkler head as recited in 8, wherein the rotatable pin has an upper surface that includes a recess for receiving a specially shaped tool, and wherein the nozzle block has a top surface which defines the top of the enclosed chamber which top surface includes an opening located in alignment with the recess in the pin, whereby a tool may be inserted through the opening into the chamber for engaging the recess to rotate the pin between locked and unlocked positions.

* * * * *

REEXAMINATION CERTIFICATE (1164th)

United States Patent [19]

Grizzle et al.

[11] B1 4,634,052

[45] Certificate Issued Dec. 5, 1989

[54] ADJUSTABLE ARC SPRINKLER HEAD

[75] Inventors: Glen Grizzle, Corona; Stephen L. Tyler, Diamond Bar, both of Calif.; Joseph J. Walto, Chaska, Minn.

[73] Assignee: The Toro Company, Minneapolis, Minn.

Reexamination Request:
No. 90/001,574, Aug. 8, 1988

Reexamination Certificate for:

| | |
|---|---|
| Patent No.: | **4,634,052** |
| Issued: | **Jan. 6, 1987** |
| Appl. No.: | **668,347** |
| Filed: | **Nov. 5, 1984** |

[51] Int. Cl.[4] ..... B05B 15/10

[52] U.S. Cl. ..... 239/205; 239/DIG. 1

[56] References Cited

U.S. PATENT DOCUMENTS 3,934,820 1/1976 Phaup ..... 239/205

3,955,764 5/1976 Phaup ..... 239/206

4,281,793 8/1981 DeWitt ..... 239/11

*Primary Examiner*—Andres Kashnikow

[57] ABSTRACT

An improved adjustable arc sprinkler head (2) includes a pop-up riser (20). Riser (20) comprises a housing (26) having a rotatable nozzle assembly (28) carried adjacent the top thereof. A driven gear (50) is fixed to nozzle assembly (28) and cooperates with a drive train contained inside a motor compartment (30) in riser housing (26). An adjustment member (58) is normally rotatably locked to driven gear (50) by matching serrations (69) and (70). Nozzle assembly (28) is moveable downwardly relative to riser housing (26) sufficiently far to disengage serrations (69) and (70) and allow driven gear (50) to be rotated relative to adjustment member (58). This rotation varies the circumferential distance between two stops (56) and (64) carried on driven gear (50) and adjustment member (58) to vary the angular extent of the arc segment being watered by sprinkler head (2).

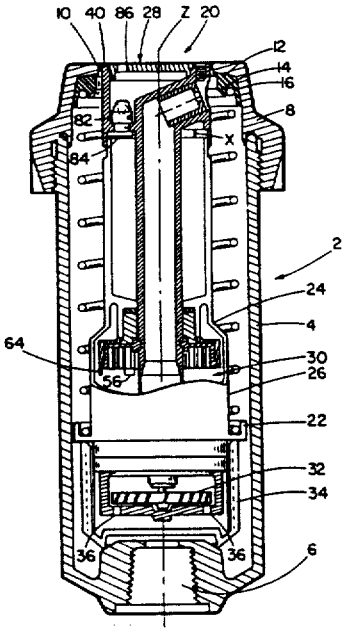

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1, 2 and 6–9 is confirmed.

Claim 3 is determined to be patentable as amended.

Claims 4 and 5, dependent on an amended claim, are determined to be patentable.

3. An improved adjustable arc [spinkler] sprinkler head of the type having a housing; a rotatable nozzle assembly carried by the housing which rotates about a substantially vertical axis to water an arc segment between first and second limits; drive means for rotating the nozzle assembly in first and second directions and for reversing the direction of rotation at each of the arc segment limits, wherein the drive means includes a driven member secured to the nozzle assembly; an adjustment member having means for coupling the adjustment member to the driven member for rotation therewith, wherein the relative rotational adjustment between the driven member and the adjustment member determines the distance between the first and second limits of the arc segment, and wherein the improvement comprises:

means responsive to movement of the nozzle assembly along the vertical axis for unlocking the adjustment member from the driven member to allow relative rotation between the two *without disassembling the nozzle assembly from the housing*, whereby the extent of the arc segment being watered may be adjusted.

* * * * *